United States Patent [19]

Endo et al.

[11] 4,057,016

[45] Nov. 8, 1977

[54] PROCESS FOR ELECTROSTATIC PRINTING AND APPARATUS THEREFOR

[75] Inventors: Ichiro Endo, Yokohama; Hajime Kobayashi, Mitaka; Nobuhiro Takekawa, Tokyo, all of Japan

[73] Assignee: Canon Kabushiki Kaisha, Tokyo, Japan

[21] Appl. No.: 685,460

[22] Filed: May 12, 1976

[30] Foreign Application Priority Data

May 19, 1975 Japan ..... 50-59389

[51] Int. Cl.[2] ..... G03G 5/026

[52] U.S. Cl. ..... 101/465; 96/1 R; 101/467; 101/DIG. 13; 346/150; 355/3 R

[58] Field of Search ..... 101/465, 467, DIG. 13; 96/1 R; 346/150; 355/3 R

[56] References Cited

U.S. PATENT DOCUMENTS

| | | | |
|---|---|---|---|
| 2,756,676 | 7/1956 | Steinhilper | 101/DIG. 13 |
| 2,839,400 | 6/1958 | Yeates | 101/DIG. 13 |
| 2,912,586 | 11/1959 | Gundlach | 101/DIG. 13 |
| 2,924,519 | 2/1960 | Bertelsen | 101/DIG. 13 |
| 3,033,765 | 5/1962 | King et al. | 101/DIG. 13 |
| 3,132,963 | 5/1964 | Jarvis | 101/DIG. 13 |
| 3,149,931 | 9/1964 | Gundlach | 101/DIG. 13 |
| 3,161,529 | 12/1964 | Curme | 101/DIG. 13 |
| 3,205,354 | 9/1965 | Glos et al. | 101/DIG. 13 |
| 3,240,596 | 3/1966 | Medley et al. | 101/DIG. 13 |
| 3,317,315 | 5/1967 | Nicoll | 101/DIG. 13 |
| 3,368,894 | 2/1968 | Natkan et al. | 101/DIG. 13 |
| 3,750,573 | 8/1973 | Haeusler et al. | 101/DIG. 13 |
| 3,806,355 | 4/1974 | Kaufman | 101/DIG. 13 |

FOREIGN PATENT DOCUMENTS

| | | | |
|---|---|---|---|
| 944,277 | 12/1963 | United Kingdom | 101/DIG. 13 |

*Primary Examiner*—Clyde I. Coughenour
*Attorney, Agent, or Firm*—Fitzpatrick, Cella, Harper & Scinto

[57] ABSTRACT

Electrostatic printing is conducted by using an electrostatic printing master composed of an insulating medium having an electric resistance sufficient to retain an electrostatic charge and conductive silver images carried in the insulating medium and heating the electrostatic printing master.

89 Claims, 11 Drawing Figures

PROCESS FOR ELECTROSTATIC PRINTING AND APPARATUS THEREFOR

BACKGROUND OF THE INVENTION

1. Field of the Invention

This invention relates to a process for electrostatic printing and an apparatus therefor, and more particularly, to an improvement in a process for electrostatic printing using an electrostatic printing master composed of an insulating medium and silver images carried therein, and an apparatus therefor.

2. Description of the Prior Art

Heretofore, there have been known many printing methods. Among them, electrostatic printing methods belong to a special printing field. Usual printing techniques are based on the principle of selectively attaching an ink to a printing master surface in accordance with the uneven surface on the printing master or the difference of solvent affinity, and then pressing the attached ink to a paper. On the contrary, in electrostatic printing the ink is not mechanically attached to a printing master, but the ink (toner) is electrostatically attached to a printing master and then transferred to a paper.

As to printing characteristics, according to usual printing methods, the ink is attached to the printing master at a relatively stable state so that many sheets of paper can be printed at a high speed, but the ink disadvantageously attaches to portions other than those to be printed. On the contrary, according to electrostatic printing methods the toner attaches electrostatically so that the attaching state is not sufficiently stable and thereby the methods are not suitable for a high speed printing usually effected under severe conditions though such problems of dirtying as mentioned above do not occur. In view of the disadvantages, electrostatic printing has not been practically used as a clean printing. In other words, electrostatic printing is poorer than conventional printing methods as to providing many sheets of print and clear print. For example, representative conventional electrostatic printing masters include a master composed of a conductive support and an insulating image overlying the conductive support and a master composed of an insulating support and a conductive image overlying the insulating support. The image may be produced by attaching an insulating or a conductive lacquer in the form of an image pattern to the support, or by coating a photosensitive lacquer on a support, imagewise exposing and selectively removing the exposed or unexposed portions by etching. The electrostatic printing masters having such a structure as above have various drawbacks in points of sharpness of the print and durability of the electrostatic printing master when used in a most conventional electrostatic printing process such as a process recycling a charging step for forming electrostatic images by selectively retaining electric charge at image portions, in case of the image portions being insulating, a developing step conducting the development with toners charged with a polarity opposite to that of the image portions and a transferring step for transferring the toner images to a transfer paper. For example, a conventional electrostatic printing master has images formed by unevenness on the surface and therefore, the uneven surface is damaged by mechanical abrasion during the printing process to form irregular charging so that the durability of the master is very low. Further it is very difficult to obtain a high resolving power from such an uneven surface type master and thereby it is also difficult technically to obtain a print having high resolution. Furthermore, it is difficult to obtain images of half tone or gradation by the use such an uneven surface type and therefore, printing of such images is very difficult.

For the purpose of solving the above mentioned problems in the prior art, U.S. Ser. No. 599,061 filed July 25, 1975 in which some of the present inventors are joint inventors discloses a process for electrostatic printing which comprises applying at least a developing procedure and a transferring procedure to an electrostatic printing master mainly composed of an insulating medium having an electric resistance sufficient to retain an electrostatic charge and a silver image carried in the insulating medium.

The desirable characteristics of the above mentioned electrostatic printing master are attributable to the fact that the silver image forming the master image is carried in an insulating medium and to the high resolution and continuous gradation of the silver image itself. The silver image is carried in the insulating medium and thereby the image of the master is not formed by the unevenness of the master surface so that the image is hardly damaged by mechanical abrasion and the master has an excellent durability. The silver image is made of an assembly of fine metallic silver particles and the resolving power is at the fine particle level so that the resolution is very excellent. Further, since silver images are employed, the density can be changed according to optional continuous gradation by the concentration of fine grains of metallic silver and images of continuous gradation can be easily regenerated.

Such excellent features can be confirmed by the fact that in the electrostatic printing process the optical high resolution and continuous gradation of the silver image directly contribute to the formation of electrostatic images of a high resolution and continuous gradation and the resulting print has an image quality similar to ordinary silver salt photography with respect to almost all points. The remarkable feature resides in that the silver image can be used as an electrostatic printing master and the high resolution and continuous gradation can directly contribute to the electrostatic printing.

This electrostatic printing master may be formed by photographically exposing a silver salt photosensitive member and therefore, the sensitivity and panchromatism are far better than those of conventional electrostatic printing masters. Further, the fidelity to the original is far better than that of a conventional one and the master can be produced within only a short time.

Consequently, the electrostatic printing method can give several thousand clear and sharp copies within a short time, that is, high speed multiple copying is possible.

The present invention resides in an improvement in the above mentioned electrostatic printing process and succeeds in giving an electrostatic print having far less fog.

SUMMARY OF THE INVENTION

An object of the present invention is to provide a process for electrostatic printing capable of producing many sheets of clear and sharp copy within a very short time with the resulting prints being far less foggy.

According to the present invention there is provided a process for electrostatic printing comprising using an electrostatic printing master mainly composed of an insulating medium having an electric resistance sufficient to retain an electrostatic charge and a silver image carried in the insulating medium which comprises at least the step of heating the electrostatic printing master.

BRIEF DESCRIPTION OF THE DRAWINGS

FIG. 4, FIG. 5, FIG. 6 and FIG. 7 show a charging step, a developing step, a transferring step and a cleaning step, respectively;

DESCRIPTION OF THE PREFERRED EMBODIMENTS

Figure 1:
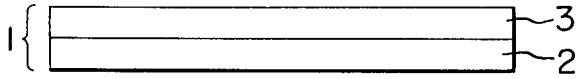
FIG. 1 shows an embodiment of a photosensitive member used for forming an electrostatic printing master according to the present invention.

The electrostatic printing master of the present invention may be usually produced from a silver salt photosensitive member. FIG. 1 is one of the representative silver salt photosensitive members. The silver salt photosensitive member 1 in FIG. 1 is composed of a silver salt photosensitive layer 3 and a base 2, and silver salt photosensitive layer 3 is mainly composed of a conventional silver salt compound capable of forming isolated silver and an insulating medium.

Representative silver salt photosensitive layers are emulsion layers of silver halide emulsion for photography, Lippmann emulsion for high resolution, emulsion for high resolution dry plate, silver salt emulsion for plate making (for example, direct positive emulsion) and the like. These emulsion layers are well known photosensitive materials, and can form silver images by wet developing after exposure.

Formation of silver images by a dry process is usually so simple that it is preferable from a practical point of view. An example of a photosensitive material for such a dry process is composed of an organic silver salt, a reducing agent and a halide (whose amount is small as compared with that of the organic silver salt), in an insulating medium. When such dry type photosensitive material is used, silver images can be produced by heat development after imagewise exposure so that a series of procedures from the formation of the electrostatic printing master from an original to the formation of electrostatic image formation can be continuous within a short time. Therefore, such process is one of the preferable embodiments of the present invention.

This dry developing photosensitive material can be of a heat developing type, and the silver image may be produced by imagewise exposure simultaneously with heat development, or imagewise heating development simultaneously with or after blanket exposure.

This dry developing photosensitive material may be produced by coating the organic silver salt and the halide dispersedly mixed with a binder, an insulating medium, on an optional base to produce an organic silver salt layer and then applying the reducing agent mixed with a resin such as acetyl cellulose and the like, by using an appropriate solvent, to the surface of the organic silver salt layer to form a reducing agent layer.

The reducing agent may be incorporated into the organic silver salt layer or may be coated on the organic silver salt layer containing the reducing agent.

Each of the above mentioned components may be incorporated in a different layer. The reducing agent may be applied to the surface of the organic silver salt layer which has been already imagewise exposed and then the heat development may be effected.

Representative organic silver salts used in the present invention are silver salts of organic acids, mercapto compounds, imino compounds and the like, and organic silver complex salts.

1. Silver salts of organic acid a. Silver salts of the following fatty acids:

For example, acetic acid, propionic acid, butyric acid, valerianic acid, caproic acid, enanthic acid, capric acid, pelargonic acid, caprylic acid, undecylic acid, lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, lacceric acid, acrylic acid, crotonic acid, 5-hexenoic acid, 2-octenoic acid, oleic acid, 4-tetradecenoic acid, 13-docosenoic acid, stearolic acid, behenolic acid, and 9-undecylenic acid.

b. Silver salts of other organic acids:

For example, arachidic acid, hydroxystearic acid, benzoic acid, 4-n-octadecyloxydiphenyl-4-carboxylic acid, o-aminobenzoic acid, p-nitrobenzoic acid, p-phenylbenzoic acid, acetamidobenzoic acid, phthalic acid, salicylic acid, oxalic acid, picolinic acid, quinolinic acid, $\alpha,\alpha'$-dithiodipropionic acid, $\beta,\beta'$-dithiodipropionic acid, thiobenzoic acid, p-toluenesulfonic acid, dodecylbenzenesulfonic acid, taurine, p-toluenesulfinic acid, and diethyldithiocarbamic acid.

2. Mercapto compounds

For example, silver 2-mercaptobenzoxazole, silver 2-mercaptobenzimidazole, and silver 2-mercaptobenzothiazole.

3. Imino compounds

For example, silver 1,2,4-triazole, silver benzimidazole, silver benztriazole, silver 5-nitrobenzimidazole, silver 5-nitrobenztriazole, and silver o-sulfobenzimide.

4. Silver complex salts

For example, silver di-8-oxyquinoline, and silver phthalazinone.

As typical examples of the halide, there may be mentioned:

1. Inorganic halides

The inorganic halide is preferably that having the general formula: $MX_m$ wherein X is a halogen (for example, cl, Br or I), M is hydrogen, ammonium or a metal (for example, potassium, sodium, lithium, calcium, strontium, cadmium, chromium, rubidium, copper, nickel, magnesium, zinc, lead, platinum, palladium, bismuth, thallium, ruthenium, gallium, indium, rhodium, beryllium, cobalt, mercury, barium, silver, cesium, lanthanum, iridium and aluminum), and when M is a hydrogen or ammonium, $m$ is 1, and when M is a metal, $m$ is the valency of the metal.

In addition, silver chloride.silver bromide, silver chloride.silver bromide.silver iodide, silver bromide.silver iodide, and silver chloride.silver iodide may be preferably used.

2. Halogen-containing organic compounds

For example, carbon tetrachloride, chloroform, trichloroethylene, triphenylmethyl chloride, triphenylmethyl bromide, iodoform, bromoform, and cetylethyldimethylammonium bromide.

The mechanism of action of these halides is not yet clear, but it may be considered as follows. As to silver halides, the exposure causes the production of isolated silver and the silver thus isolated becomes a developing nucleus upon developing and accelerates isolation of silver from the organic silver salt to form silver images. As to halides other than silver halides, the halides react with the organic silver salt to produce silver halides and then the silver halides act in the same way as those above, that is, isolated silver is formed and acts as a developing nucleus and silver images are produced.

The as above halides may be used alone or in combination.

The amount of the halide is usually less than 1 mole, preferably less than $10^{-1}$ mole, more preferably $10^{-1}$ – $10^{-5}$ mole per 1 mole of organic silver salt.

Representative reducing agents are as shown below:

Hydroquinone, methyl hydroquinone, chlorohydroquinone, bromohydroquinone, catechol, pyrogallol, methylhydroxynaphthalene, aminophenol, 4,4'-butylidene-bis(6-t-butyl-3-methylphenol), 4,4'-bis(6-t-butyl-3-methylphenol), 4,4'-thio-bis(6-t-butyl-2-methylphenol), 2,6-di-t-butyl-p-cresol, 2,2'-methylene-bis(4-ethyl-6-t-butylphenol), phenidone, metol, 2,2'-dihydroxy-1,1'-binaphthyl, 6,6'-dibromo-2,2'-dihydroxy-1,1'-binaphthyl, bis(2-hydroxy-1-naphthyl)methane, 2,2'-methylene-bis(6-t-butyl-p-cresol) and mixtures thereof.

Other than the above mentioned reducing agents, if desired, there may be used dye sensitizers, toning agents, stabilizers and other additives.

It is also possible to carry out a developing procedure without incorporating a developing agent (a reducing agent) into the photosensitive layer, that is, it is possible to effect an external type of wet developing procedure. For example, a developing solution containing a reducing agent as mentioned above is applied to a buffer solution adjusted to a low pH. Fixing may be effected with a usual solution of sodium thiosulfate.

In case of heat developable photosensitive materials, photosensitive materials not containing any halide are subjected to a preliminary heat treatment, and then exposed and heat-developed into form silver images. Image informations are given upon exposure or heat-developing treatment.

As the insulating medium in which the organic silver salt is dispersed, there may be mentioned polystyrene resin, polyvinyl chloride resin, phenolic resin, polyvinyl acetate resin, polyvinyl acetal resin, epoxy resin, xylene resin, alkyd resin, polycarbonate resin, poly(methylmethacrylate) resin, polyvinyl butyral resin, gelatin resin, polyester, polyurethane, polyvinyl acetate, synthetic rubber, polybutene, and the like.

If desired, a plasticizer may be added. As the plasticizer, there may be mentioned dioctyl phthalate, tricresyl phosphate, diphenyl chloride, methyl naphthalene, p-terphenyl, diphenyl and the like.

As the photosensitive material for preparing the electrostatic printing master, there may be used conventional materials as shown below.

For example, there can be used a photosensitive material for forming silver images by diffusion transferring. The negative material having a gelatin layer containing a silver halide is exposed, soaked in a solvent capable of dissolving silver halide and contacted with a positive material having a gelatin layer containing colloidal silver in the solvent, and thereby the silver halide corresponding to the unexposed portion of the negative material is dissolved in the solvent and diffuses into the gelatin layer of the positive material and is reduced at the colloidal silver in the positive material serving as developing nuclei to separate silver and form positive silver images.

Another method is a method known as auto positive. The photosensitive material having a gelatin layer containing a silver halide is subjected to a blanket exposure and then an imagewise exposure. As the result, the imagewise exposed portion loses its ability of reducing and separating silver in the subsequent developing treatment, according to Herschel effect, and silver separates at a portion other than the imagewise exposed portion to form silver images.

A further photosensitive material is that which has a vapor deposited silver halide layer, and silver images can be obtained by treating the silver halide layer in a conventional manner, i.e. exposure-development-fixing.

Still another photosensitive material is that known as photosolubilization, that is, fixing a gelatin layer containing a silver halide with mercaptans or thioureas, exposing, developing and washing with water to form silver images.

When a photosensitive member is produced by using the above mentioned photosensitive material as a photosensitive layer, usually a base is coated with the photosensitive material and in general, the coating procedure may be a conventional one often used for forming a thin film of synthetic resins. For example, there may be mentioned a rotary coating of an emulsion solution, a wire-bar coating, a flow-coating, and air-knife coating, and the film thickness can be adjusted accordingly, for example, to from several microns to about 100 microns.

The base may be a metal plate such as aluminum, copper, zinc, silver and the like, a metal laminate paper, a paper treated to prevent permeation of a solvent, a paper treated with a conductive polymer, a synthetic resin film containing a surface active agent, a glass, paper, synthetic resin, film and the like having on the surface a vapor-deposited metal, metal oxide or metal halide. Further, there may be used an insulating glass, paper, synthetic resin and the like. In particular, a flexible metal sheet, paper or other conductive materials which can be wound on a drum are preferable.

When a conductive base is used, it is usually necessary that the specific resistance is lower than that of a non-silver image area of the photosensitive layer in which silver images have been formed, and the specific resistance is preferably less than $10^9$ ohm.cm. and more preferably less than $10^5$ ohm.cm.

Figure 2:
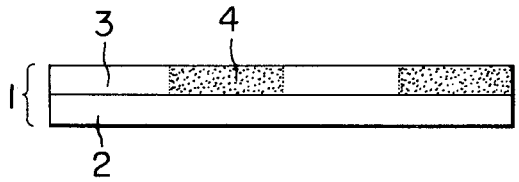
FIG. 2 shows a photosensitive member in which latent images are formed.
Figure 3:
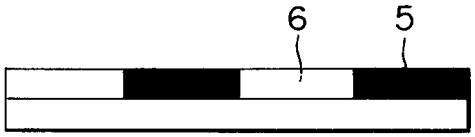
FIG. 3 shows an embodiment of an electrostatic printing master according to the present invention.

For the purpose of preparing a master for electrostatic printing, a photosensitive member formed from various photosensitive materials capable of forming a silver image is subjected to imagewise exposure to form a latent image 4 on the exposed portion as shown in FIG. 2, and then the developing treatment is carried out to form a silver image on the exposed portion 5 (silver image portion) as shown in FIG. 3. No silver image is formed on the unexposed portion 6 (non-silver image portion).

The specific resistances $\rho_1$ and $\rho_2$ of the silver image portion and the non-silver image portion, respectively are optionally determined so that sufficient electrostatic contrast may be formed between these portions. $\rho_2$ is preferably larger than $\rho_1$ by two or more places, more preferably, by three or more places. The specific resistance $\rho_1$ may be usually less than $10^{13}$ ohm.cm, more preferably less than $10^{10}$ ohm.cm.

On the other hand, the specific resistance $\rho_2$ may be usually more than $10^{10}$ ohm.cm., preferably more than $10^{11}$ ohm.cm., more preferably more than $10^{13}$ ohm.cm.

The thickness of the layer bearing the silver image may be optionally determined in view of the purpose, use and durability, and it may be usually in the range of from 1 micron to 50 microns, more preferably from 2 microns to 30 microns.

The most fundamental electrostatic printing process according to the present invention comprises repeating a charging step, a developing step and a transferring step, and a heating step is inserted at an optional point.

Further, when the electrostatic printing master is prepared from a heat developable photosensitive member, the steps for such purpose, that is, the imagewise exposing and heat developing steps can be incorporated into the electrostatic printing process as the preparative step, and therefore, it becomes possible to attain a continuous process. If necessary, other additional steps, for example, cleaning and fixing steps, may be incorporated into the electrostatic printing process at the time of putting the fundamental process in practice. In addition, as stated below, the fundamental process may be carried out in various embodiments.

Figure 4:
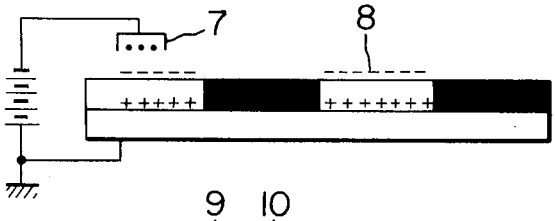
FIG. 4 – FIG. 7 show embodiments of a series of electrostatic printing steps using an electrostatic printing master according to the present invention.
Figure 5:
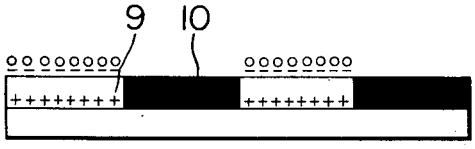
Figure 6:
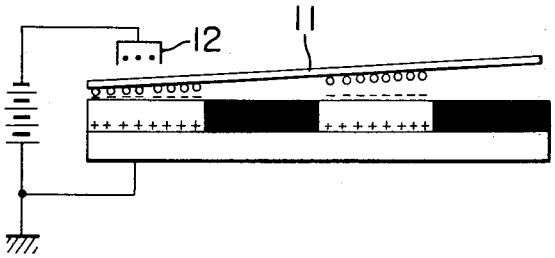
Figure 7:
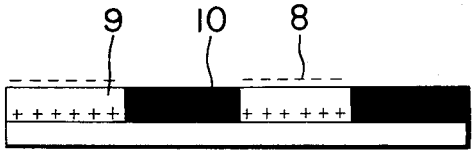

An example of the most fundamental electrostatic printing process is illustrated in FIGS. 4 – 7 comprising a step for producing electrostatic images, a developing step and a transferring step. As shown in FIG. 4, a master bearing a silver image is caused to pass under, for example, a negative corona electrode 7 so that negative charges 8 can be formed on the surface region having no silver image, that is, non-silver image portion of the master. In this case, either a positive corona electrode or an alternating current corona electrode may be used in place of the negative corona electrode, and a contact electrode may be utilized in place of the corona electrode. As the result of the above-mentioned charging, a latent image of the electrostatic charges is selectively formed on the region having no silver image in the master. Such latent image of the electrostatic charges is subjected to a toner treatment in a usual manner, for example, cascade, magnetic brush, liquid, Magne-dry and wetting developments as shown in FIG. 5. If the toner particles are electrically conductive and charges are not particularly imparted thereto, or if they have charges opposite to those of the image of the electrostatic charges, they adhere to a portion 9 to which charges are imparted. On the other hand, if the same charges as those of the image are imparted to the toner particles, the particles adhere to a portion 10 to which charges are not imparted. As shown in FIG. 6, a transfer material 11 is brought into contact with the surface of the toner image and the toner image can be transferred to the transfer material 11 by using, for example, a corona electrode 12 of the opposite polarity to that of the toner from the back side of the transfer material 11. The toner image thus transferred can be fixed by techniques conventionally known in the art. Usually, heating fixation, solvent fixation and the like are employed. Where liquid development is carried out, it is sufficient to merely heat the toner image. In addition, a pressure-fixation method may be adopted. Subsequently, if necessary, the surface of the master may be cleaned by using a cleaning means such as a brush, a fur brush, cloth, a blade and the like to remove the remaining toner image as shown in FIG. 7.

The electrostatic printing process is carried out either by the above-mentioned charging-developing-transferring-cleaning process or by a recycle of the developing-transferring-cleaning process in which the durability of the electrostatic latent image is utilized. In this case, the cleaning step may be omitted if desired. In a particular case, it is possible that an image having a sufficiently large amount of the toner is formed on the master in the first process to repeat the transferring of the toner image onto a different transfer material several times or more.

According to the present invention, the electrostatic printing process contains at least one step of heating the electrostatic printing master, but it is not always necessary to effect the heating at least once in each copying cycle. Neither is it always necessary to effect the development at least once in each cycle.

Other steps such as cleaning step, fixing step and the like may be added, if desired.

The heating step is effected so as to form electrostatic images having less fog by heating the electrostatic printing master. According to the present invention, the electrostatic image is to be formed under the effect of heat. The heating may be conducted at any point of the process as long as the heating can have an effect on the formation of electrostatic images. It is necessary only that the heating be conducted during at least one point of the electrostatic printing process.

The heating may be conducted at any optional point or points, for example, before or after the electrostatic image forming step, after the developing step, or after the transferring step. Needless to say, the heating step may be conducted simultaneously with other step or steps.

According to the present invention, the heating may be applied to the electrostatic printing master at least one point, and this may include keeping the electrostatic printing master at a constant temperature throughout the whole process, or the electrostatic printing master is kept at a constant temperature only when one or more specific steps are conducted.

If a toner fuses by heating, it is better to avoid heating the electrostatic printing master between the developing step and the transferring step.

The heating of the electrostatic printing master results in increasing sufficiently the electric potential contrast between the silver image portions and non-image portions after charging, lowering sufficiently the electric potential after charging (remaining electric potential), minimizing the adverse change of electric characteristics of the electric printing master caused by repeating the electrostatic printing many times, and minimizing the change of electric characteristics of the electrostatic printing master after producing the electrostatic printing master as the time lapses.

The heating temperature at the heating step varies depending upon the type and characteristics of the electrostatic printing master, electrostatic printing speed, number of repeating, charging polarity, charging voltage, electric characteristics of developers, type of the transfer material and the like. However, the heating temperature is usually 40° - 120° C, preferably 50° - 100° C, more preferably 60° - 100° C. If necessary, the optimum heating temperatures can be easily determined by a simple test operation.

The heating should be conducted with care so as not to damage the images formed on the electrostatic printing master.

As mentioned above, the heating may be effected at least once in one cycle in the electrostatic printing process or intermittently.

The heating step may be conducted by using radiation heat, convection heat and/or conduction heat.

As examples of using radiation heat, there are used heat generating light sources such as an infrared lamp, tungsten lamp, mercury lamp, xenon lamp, halogen lamp, various flash lamps, light emitting diode, laser and the like and electric heaters.

As an example of convection heat, a high temperature gas such as air and the like may be blown into the electrostatic printing master. As an example of using conduction heat, a heat roll is provided adjacent to the electrostatic printing master to heat the master. The above mentioned heating methods may be used in combination.

It is not an important matter in the present invention which heating means is employed. Therefore, the heating means may be selected optionally taking into consideration, for example, heat transfer rate, cost, safety and so on.

An operation for obtaining an electrophotographic image can be effected by a conventional technique. For example, as the means of imparting electrostatic charges to a master, it is caused to pass under a corona discharging apparatus at +6 KV several times to impart positive charges to the master, in case of which the electric potential reaches several hundreds — 1,500 V.

The polarity of the corona discharging may be either positive or negative direct current corona, and an alternating current corona may be used, and alternatively an electrode may be directly brought into contact with the master to impart electrostatic charges to the master. The electric potential due to the electrostatic charges is determined so as not to give rise to dielectric breakdown of the master or spark.

Figure 8:
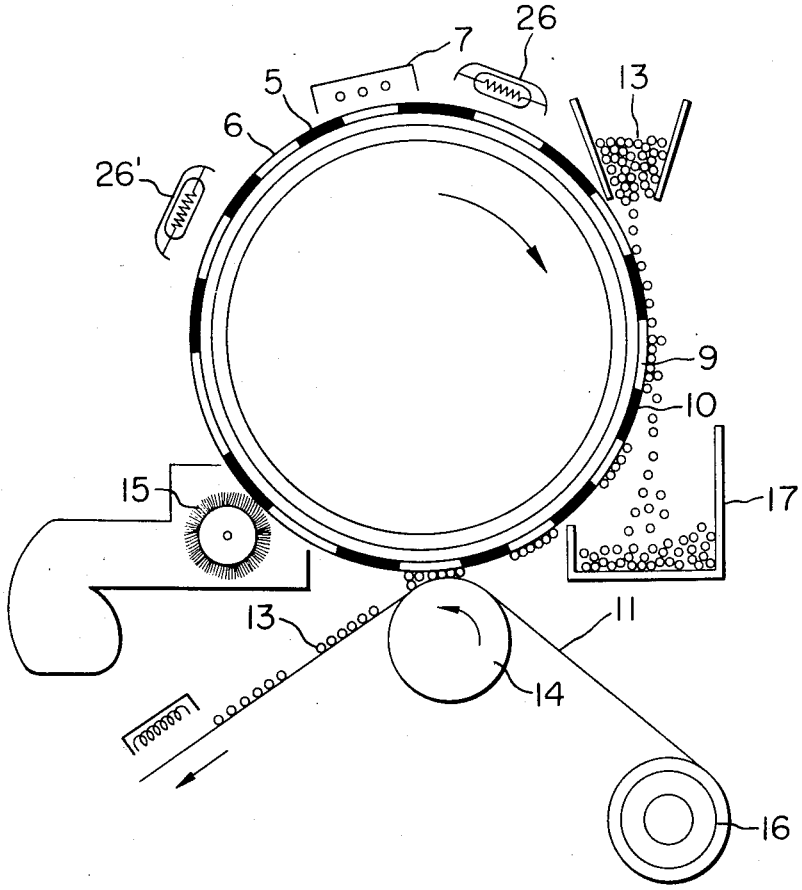
FIG. 8 shows an embodiment for carrying out the present invention.

For the purpose of recycling the electrostatic printing process at a high speed, the process may be carried out by rotation of a drum as shown in FIG. 8. The electrostatic printing master having the silver image portion 5 and non-silver image portion 6 is placed, for example, on an electroconductive drum, rotated in the direction of the arrow and charged by means of the corona electrode 7, and subsequently, cascade development is carried out with the toner 13. The toner particles adhere selectively and electrostatically to the non-silver image portion 9 to which electrostatic charges are imparted. The remaining toner particles are collected in a toner receiver 17. The developed toner image is then transferred onto a transfer material 11 fed by a paper-feeding roller 16 by means of a transfer roller 14, and, if necessary, an electric field of the opposite polarity to that of the toner charge is applied to the transfer roller 14 if necessary. The transferred toner image is fixed by heat from a heater to give an electrostatic printed matter. The electrostatic printing master is cleaned by a cleaning means 15 (brush cleaning) after the toner image is transferred. The heating step for the electrostatic master can be effected by optional heating means 26 and 26' (In FIG. 8 are shown infrared lamps.) Two heating means are shown, but it is not always necessary to use both and one of them may be used.

Figure 9:
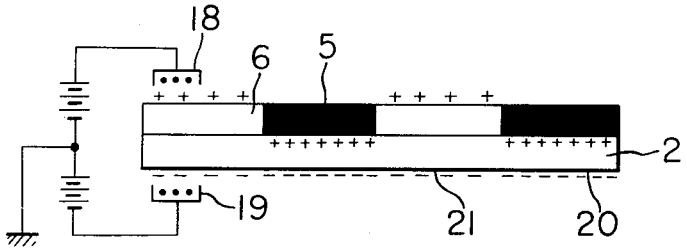
FIG. 9 – FIG. 11 show other embodiments of the electrostatic printing process according to the present invention.

FIG. 9 illustrates an embodiment in which the base 2 of an electrostatic printing master has insulating properties and the electrostatic printing master is subjected to double corona charging by corona electrodes 18 and 19, the polarities of which are selected so as to be opposite to each other. Owing to the charging, in the non-silver image portion 6, electrostatic charges are imparted to both sides of the electrostatic printing master, in case of which the polarity of the charges on one side of the master is opposite to that of the charges on the other side. On the other hand, in the silver image portion 5, the electrostatic charges imparted by the corona electrode 18 reach the interface between the silver image portion 5 and the base 2 through the silver image portion 5 and charged there since the silver image is electrostatically conductive. As the result, the silver image portion retains a large amount of the electrostatic charges through the base as compared with the non-silver image portion depending upon the difference in the electrostatic capacity between the silver image portion and the non-silver image portion which results from the difference in the interval for retaining charges between both portions. Consequently, the electrostatic charges are retained on the base surface 20 corresponding to the silver image portion in a higher charge density while they are retained on the base surface 21 corresponding to the non-silver image portion in a lower charge density so that an electrostatic image is formed. On the other hand, in the upper surface of the electrostatic printing master, the electrostatic charges are retained only on the non-silver image portion 6, thereby forming an electrostatic image. The latter electrostatic image and that formed on the base surface are in relation of positive-negative with respect to the electrostatic contrast. The electrostatic image formed on the upper surface of the electrostatic printing master is developed with a toner having a polarity opposite to that of the electrostatic image to give a positive visible image, whereas it is developed with a toner having the same polarity as that of the electrostatic image to give a negative visible image although the contrast is deteriorated. On the other hand, the electrostatic image formed on the surface of the base is developed with a toner having a polarity opposite to that of the electrostatic image to give a negative visible image, whereas it is developed with a toner having the same polarity as that of the electrostatic image to give a positive visible image although the contrast is decreased. In case of the development with the toner having the same polarity as that of the electrostatic image, the electric potential of the toner is determined so that the electrostatic image to be developed may be sufficiently visualized. Needless to say, as the charging means, those other than the corona electrode may be optionally used as mentioned above.

Figure 10:
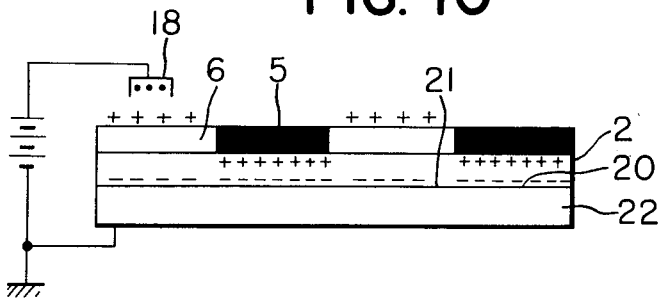

FIG. 10 illustrates one of the examples of other charging means, in which a charging electrode 22 is provided on the surface of the base 20 in place of the corona electrode 19. The charging electrode 22 may be previously formed integrally with the electrostatic printing master or it may formed separately. Further, it may be in the type of such a drum as shown in FIG. 8.

The charging electrode may be removed after the charging.

Figure 11:
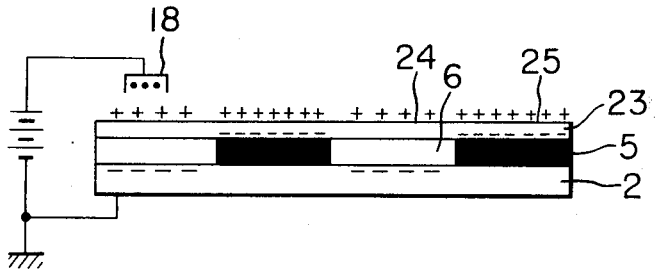

FIG. 11 illustrates another embodiment of the electrostatic printing process of the present invention using an electrostatic printing master having an electro-conductive base 2 and being provided with an insulating layer 23. The electrostatic printing master is charged by means of the corona electrode 18. As a result, the electrostatic charges on the non-silver image portion 6 are retained on both the portion 24 of the insulating layer 23 and the interface between the non-silver image portion and the base, whereas the electrostatic charges on the silver image portion 5 are retained on both the portion 25 of the insulating layer 23 and the interface between the insulating layer and the silver image portion. The non-silver image portion is small in the electrostatic capacity due to the long distance for retaining the electrostatic charges, and therefore the charge density of the non-silver image portion is small. On the other hand, the charge density of the silver image portion is large since its electrostatic capacity is large due to the short distance for retaining the electrostatic charges. As a result, an electrostatic image having a contrast in which a small amount of the electrostatic charges is retained on the non-silver image portion and a large amount thereof is retained on the silver image portion is formed on the surface of the insulating layer 23. The formed electrostatic image is developed with a toner having a polarity opposite to that of the electrostatic charges of the image to give a negative visible image while it is developed with a toner having the same polarity as that of the electrostatic image to give a positive visible image. In case of the development with the toner having the same polarity as that of the image, the electric potential of the toner is determined in order that it may adhere selectively to the non-silver image portion. Needless to say, in the embodiment of FIG. 11, other charging means may be optionally adopted as in the case of FIG. 9. The insulating layer may be previously formed integrally with the electrostatic printing master, or it may be formed in other optional manners. This embodiment is useful and effective in that the insulating layer can function also as a protection layer.

In the embodiments illustrated in FIGS. 9 – 11, the developed visible image, i.e. the toner image is transferred onto the transfer material as shown in FIG. 6, and if necessary, the electrostatic printing master is then subjected to cleaning treatment, and subsequently, the charging-developing-transferring steps or developing-transferring steps are repeated. When the difference in the electrostatic capacity between the non-silver image portion and the silver image portion is utilized to form an electrostatic image as in the embodiments shown in FIGS. 9 – 11, the thickness of the insulating layer and the silver image-bearing layer is determined in order that the contrast of the electrostatic image may be more than a practical level. Further, the heat treatment of the electrostatic printing master is effected in such a way that the heating makes the electrostatic image less foggy. In addition, a typical structure of the electrostatic printing master used in the present invention is as illustrated in FIG. 3. However, if necessary, the base may be omitted. When the master having no base is applied to the electrostatic printing process, it may be placed on a carrier plate, or in the charging step, the charging may be carried out simultaneously from both sides of the master, for example by applying double corona discharging of opposite polarity to to both sides of the master.

According to a further embodiment of the present invention, there is used a process utilizing an electrostatic transfer. For example, electrostatic images formed on an electrostatic printing master are transferred to a transfer member and the electrostatic images thus transferred are developed to give visual images. And at least one point of this process the electrostatic printing master is heated.

For example, this electrostatic image transfer is effected by placing the surface of an electrostatic image formed on the surface of an electrostatic printing master close to the surface of an insulating transfer member, face to face, and applying an external electric field to the electrostatic printing master and the transfer member to produce a second electrostatic image on the surface of the transfer member. In this method, electric charge is transferred to the transfer member by the difference of field emission between the electric charge at non-image portions of the electrostatic printing master and that at the silver image portions, and thereby the second electric image is formed on the transfer member.

A still further embodiment of the electrostatic transfer is a transfer effected without applying any external electric field. According to this method, the surface electric potential at the silver image portion of the electrostatic printing master is controlled to a maximum value at which field emission or gas discharge does not occur, and the surface electric potential at the non-silver image portion is controlled to a value of not lower than the minimum value of field emission, and thereby, without any external electric field, the electrostatic images can be transferred to the transfer member by simply short-circuiting the back surface of the transfer member and the back surface of the electrostatic printing master to make them have almost the same an electric potential. Thus, electric charge having the same polarity as that at the non-silver image portion is formed on the transfer member surface as a transferred electrostatic image corresponding to the non-silver portion.

Heretofore it has not been known that electrostatic printing masters are heated in the electrophotographic or electrostatic printing art, because the electric properties of the masters are usually adversely affected by heating.

However, according to the present invention, heating the electrostatic printing master gives more improved electrostatic printing. The mechanism by which heating the electrostatic master results in improvement in the electrostatic printing is not yet clear, but it is considered that the difference between the thermal conductivity of silver images and that of the insulating medium and the change of electric characteristics caused by heat may contribute to the improvement.

According to the present invention, heating the electrostatic printing master remarkably contributes to retaining proper electric characteristics of the electrostatic printing master and removing the remaining electric charge on the electrostatic printing master and thereby many sheets of clear and sharp copy can be obtained. The heating serves to eliminate fog (e.g. caused by toner attached to the silver image portion of the electrostatic printing master) often occurring upon producing many sheets of copy. The heating step according to the present invention can broaden the selection range of operation conditions for producing many sheets of clear and sharp copy by an electrostatic printing employing an electrostatic printing master having silver images carried in an insulating medium, and further enables one to produce copies at high speed and the commercial value of electrostatic printing processes are enhanced.

The following examples are given for illustrating the present invention, but by no means for restricting the present invention.

REFERENCE EXAMPLE

In a ball mill, 20 g. of silver behenate, 150 g. of methyl ethyl ketone and 150 g. of toluene were mixed, and pulverized for 72 hours to prepare a uniform slurry. Then, 100 g. of a 20% solution of a polyvinyl butyral resin (S-Lec BM-1, a trade name for product of Sekisui Kagaku K. K.) in ethyl alcohol was added to the slurry and gently mixed for about 3 hours. 0.12g of mercury acetate, 0.2 g. of calcium bromide and 5.0 g. of phthalazinone were successively added to the mixture. The resulting mixture was uniformly coated onto an aluminum plate having a thickness of 100 microns by a coating rod and dried at 80° C for 3 minutes.

The mixed solution of the following composition was coated onto the silver behenate layer formed as mentioned above.

| | |
|---|---|
| 2,2'-methylene-bis-6-t-butyl-p-cresol | 1.5 g. |
| Phthalazinone | 0.3 g. |
| Cellulose acetate (Daicel L-30, a trade name for a product of Daicel Ltd.),acetone 10% solution | 10 g. |
| Acetone | 30 g. |
| Dye sensitizer | 0.005 g. |

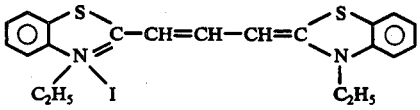

The above-mentioned operations were all conducted in the dark.

The photosensitive plate thus prepared was exposed to a tungsten light source (60 lux) through a positive image for 2 seconds, and then a heating apparatus of a roller type was used to carry out the development so that a negative print was obtained by heating at 130° C for 2 seconds.

Then the photosensitive plate was uniformly given a corona discharging at −7KV and developed with a positively charged toner by a magnet brush developing and further the resulting toner images were transferred to a transfer paper by applying a corona charging from the transfer paper side to produce visible images on the transfer paper. The visible images were fixed by using a heater.

EXAMPLE 1

Repeating the procedure of the Reference Example, there was obtained a photosensitive member comprising silver behenate. From this photosensitive member there were prepared two samples. One sample (Sample A) was prepared by applying a blanket exposure to the photosensitive member at the same light amount as in the Reference Example and then heat-developing. The other sample (Sample B) was prepared by heat-developing the photosensitive member without a blanket exposure.

The resulting Samples A and B were heated by blowing warm air on to the samples before charging. As the result, the surface electric potentials shown in the following table were obtained.

| Case | Heating Conditions: Temperature at the blowing outlet ° C | Air Speed m./sec. | Sample A (V) | Sample B (V) | Contrast (V) |
|---|---|---|---|---|---|
| 1 | No heating | | −350 | −700 | 350 |
| 2 | About 90 | 7.5 | −100 | −500 | 400 |
| 3 | About 80 | 9.0 | −150 | −530 | 380 |
| 4 | About 70 | 10.5 | −170 | −530 | 360 |
| 5 | About 60 | 12.0 | −200 | −530 | 360 |

The air blowing was effected at a distance of 15 cm. from Sample A and Sample B at ambient temperature. The surface electric potential was measured by Electrostatic Paper Analyzer Model SP-428 (trade name, manufactured by Kawaguchi Denki). The air blowing was effected for 20 seconds, and at 10 seconds after finishing the blowing, charging was effected at −7KV for 5 seconds and then at 2.5 seconds later the surface electric potential was measured.

The result as mentioned above shows that heating the electrostatic printing master results in a decrease in the surface electric potential at the silver image portion after charging and thereby the remaining electric charge which is a cause of fog is remarkably reduced.

EXAMPLE 2

Using Samples A and B as used in Example 1 and carrying out developing with toner, transferring and fixing according to the procedure of the Reference Example above, the image density thus obtained was measured.

The results are shown below.

| Case | Density of transferred images Sample A | Density of transferred images Sample B |
|---|---|---|
| 1 | 0.82 | 1.40 |
| 2 | 0.20 | 1.31 |
| 3 | 0.30 | 1.32 |
| 4 | 0.33 | 1.31 |
| 5 | 0.35 | 1.30 |

The above results indicate that the heating of the electrostatic printing master lowers the fog density at the silver image portion to a great extent and the image quality is improved.

EXAMPLE 3

Repeating the procedure of the Reference Example except that a base composed of a polyester film (Mylar film) of 70 microns thickness having a vapor-deposited aluminum on the surface was used in place of the aluminum plate, the resulting electrostatic printing master was put around a rotating drum as shown in FIG. 8 and the recycle process of charging, developing with toner (cascade development), transferring and cleaning was conducted.

In the system as shown in FIG. 8, there was used a rotatable drum of 20 cm. in diameter and 20 cm. in width and there was provided an infrared bulb for medical treatment (125W, manufactured by Toshiba) both before and after the charging device at a distance of 40 cm.

The above apparatus was used for copying in a way similar to Example 2 to produce continuously 1000 sheets of copy and the resulting image density was measured. The results are shown in the table below.

| | 10th sheet | 100th sheet | 200th sheet | 400th sheet | 600th sheet | 800th sheet | 1000th sheet |
|---|---|---|---|---|---|---|---|
| Without infrared ray | 0.8/1.4 | 0.8/1.4 | 0.9/1.4 | 0.9/1.4 | 1.0/1.5 | 1.0/1.5 | 1.2/1.5 |
| Only the infrared lamp before the charging device was used. | 0.3/1.3 | 0.3/1.3 | 0.3/1.3 | 0.4/1.3 | 0.4/1.4 | 0.4/1.4 | 0.4/1.4 |
| Two infrared lamps were used | 0.2/1.2 | 0.2/1.2 | 0.2/1.2 | 0.2/1.3 | 0.3/1.3 | 0.3/1.3 | 0.3/1.3 |

The above results show that heating the master results in a decrease in the change caused as the time lapses and a decrease in deterioration due to the continuous use (Rotation of the drum of once/sec. and one sheet of copy obtained per one rotation of the drum).

EXAMPLE 4

Following the procedure of Example 3 except that the electrostatic printing master was heated by contacting a heating metal drum with the master in place of the infrared lamp and the heating metal drum was made of a stainless steel and was of 15 cm. in diameter and further was coated with a silicone rubber so as to prevent the adhering with the electrostatic printing master, the results are as shown below.

| Surface temperature of the heating metal drum | Transferred density when Sample A was used | Transferred density when Sample B was used |
|---|---|---|
| 50° C | 0.35 | 1.28 |
| 60° C | 0.35 | 1.25 |
| 70° C | 0.31 | 1.20 |
| 80° C | 0.30 | 1.20 |
| none | 0.80 | 1.40 |

The above results also show the effects similar to that of the previous Example.

EXAMPLE 5

In Example 3 and the process as shown in FIG. 8, an infrared lamp was arranged at a distance of 45 cm. as a heating means before the charging device.

Repeating the procedure of Example 2 by using this apparatus, there were produced continuously 1000 sheets of transferred copy. In this Example, the infrared lamp was turn on only once per 10 cycles of drum rotation and the result was almost the same as that in Example 3. (Rotation of the drum of once/sec. and one sheet of copy obtained per one rotation of the drum).

EXAMPLE 6

On a completely defatted aluminum plate was coated a gelatin emulsion containing colloidial silver prepared by a conventional method and dried to form a positive image receiving layer. Then the positive image receiving layer was contacted with a negative layer of a commercially available diffusion transfer member, the negative layer having been exposed through a positive original. And then the positive image receiving layer was developed by using a commercially available developing agent to obtain positive visible images on the positive layer, and this positive layer master was dried.

Using the resulting master, according to the procedure of Example 2 there were conducted toner-development, transferring and fixing, and the resulting image density was measured as shown below.

| Case | Transferred image density corresponding to a black part | Transferred image density corresponding to non-black part |
|---|---|---|
| 1 | 0.70 | 1.20 |
| 2 | 0.35 | 1.22 |
| 3 | 0.40 | 1.23 |
| 4 | 0.45 | 1.22 |
| 5 | 0.50 | 1.25 |

We claim:

1. In an electrostatic printing process which includes the steps of forming an electrostatic latent image on a smooth-surfaced electrostatic printing master, stable towards exposure to light or maintenance in the dark, having a layer which comprises an insulating medium having an electric resistance sufficient to retain an electrostatic charge and a conductive silver image in said insulating medium, developing said latent image to form a visible image, and transferring the developed visible image onto a support therefor, the improvement comprising enhancing the electrical conductivity of said silver image by heating said master at least once during said printing process sufficient to reduce the tendency of said developer to adhere thereto and create undesired fog, whereby said enhanced conductivity is imparted to said silver image portion through at least about 10 cycles of printing.

2. The electrostatic printing process of claim 17, including repeating said steps of forming, developing and transferring.

3. The electrostatic printing process of claim 1, including the step of cleaning said master after said transferring step.

4. The electrostatic printing process of claim 1, including the step of fixing the transferred image.

5. The electrostatic printing process of claim 1, wherein said heating is conducted prior to said developing step.

6. The electrostatic printing process of claim 1, wherein said heating is conducted at a temperature of from 40° to 120° C.

7. The electrostatic printing process of claim 1, wherein the specific resistance of the image portion of said layer is less than $10^{13}$ ohm-cm, wherein the specific resistance of the non-image portion of said layer is greater than $10^{10}$ ohm-cm, and wherein the specific resistance of said non-image portion is greater than the specific resistance of said image portion by at least $10^2$ ohm-cm.

8. The electrostatic printing process of claim 1, wherein the specific resistance of the image portion of said layer is less than $10^{10}$ ohm-cm, and wherein the specific resistance of said non-image portion of said layer is greater than $10^{13}$ ohm-cm.

9. The electrostatic printing process of claim 1, wherein the thickness of said layer is from 1 to 50 microns.

10. The electrostatic printing process of claim 1, wherein said silver image is formed from a silver salt compound capable of forming isolated silver.

11. The electrostatic printing process of claim 10, wherein said heating is conducted prior to said developing step.

12. The electrostatic printing process of claim 10, wherein said heating is conducted at a temperature of from 40° to 120° C.

13. The electrostatic printing process of claim 10, wherein said silver salt is an organic silver salt.

14. The electrostatic printing process of claim 13, wherein said silver image is formed from said organic silver salt by conducting at least the steps of imagewise exposure and heat-developing.

15. The electrostatic printing process of claim 14, wherein said layer comprises an insulating medium, an organic silver salt, a halide and a reducing agent.

16. In an electrostatic printing process which includes the repeated steps of developing an electrostatic latent image on a smooth-surfaced electrostatic printing master, stable towards exposure to light or maintenance in the dark, having a layer which comprises an insulating medium having an electric resistance sufficient to retain an electrostatic charge and a conductive silver image in said insulating medium, to thereby form a visible image, and transferring the developed visible image onto a support therefor, the improvement comprising enhancing the electrical conductivity of said silver image by heating said master at least once during said printing process sufficient to reduce the tendency of said developer to adhere thereto and create undesired fog, whereby said enhanced conductivity is imparted to said silver image portion through at least about 10 cycles of printing.

17. The electrostatic printing process of claim 16, including the step of fixing the transferred image.

18. The electrostatic printing process of claim 16, wherein said heating is conducted prior to said developing step.

19. The electrostatic printing process of claim 16, wherein said heating is conducted at a temperature of from 40° to 120° C.

20. The electrostatic printing process of claim 16, wherein the specific resistance of the image portion of said layer is less than $10^{13}$ ohm-cm, wherein the specific resistance of the non-image portion of said layer is greater than $10^{10}$ ohm-cm, and wherein the specific resistance of said non-image portion is greater than the specific resistance of said image portion by at least $10^2$ ohm-cm.

21. The electrostatic printing process of claim 16, wherein the specific resistance of the image portion of said layer is less than $10^{10}$ ohm-cm, and wherein the specific resistance of said non-image portion of said layer is greater than $10^{13}$ ohm-cm.

22. The electrostatic printing process of claim 16, wherein the thickness of said layer is from 1 to 50 microns.

23. The electrostatic printing process of claim 16, wherein said silver image is formed from a silver salt compound capable of forming isolated silver.

24. The electrostatic printing process of claim 23, wherein said heating is conducted prior to said developing step.

25. The electrostatic printing process of claim 23, wherein said heating is conducted at a temperature of from 40° to 120° C.

26. The electrostatic printing process of claim 23, wherein said silver salt is an organic silver salt.

27. The electrostatic printing process of claim 26, wherein said silver image is formed from said organic silver salt by conducting at least the steps of imagewise exposure and heat-developing.

28. The electrostatic printing process of claim 27, wherein said layer comprises an insulating medium, an organic silver salt, a halide and a reducing agent.

29. In an electrostatic printing process which includes the repeated steps of developing an electrostatic latent image on a smooth-surfaced electrostatic printing master, stable towards exposure to light or maintenance in the dark, having a layer which comprises an insulating medium having an electric resistance sufficient to retain an electrostatic charge and a conductive silver image in said insulating medium, to thereby form a visible image, transferring the developed visible image onto a support therefor, and then cleaning the electrostatic printing master after said transfer, the improvement comprising enhancing the electrical conductivity of said silver image by heating said master at least once during said printing process sufficient to reduce the tendency of said developer to adhere thereto and create undesired fog, whereby said enhanced conductivity is imparted to said silver image portion through at least about 10 cycles of printing.

30. The electrostatic printing process of claim 29, including the step of fixing the transferred image.

31. The electrostatic printing process of claim 29, wherein said heating is conducted prior to said developing step.

32. The electrostatic printing process of claim 29, wherein said heating step is conducted at a temperature of from 40 ° to 120° C.

33. The electrostatic printing process of claim 29, wherein the specific resistance of the image portion of said layer is less than $10^{13}$ ohm-cm, and wherein the specific resistance of the non-image portion of said layer is greater than $10^{10}$ ohm-cm and wherein the specific resistance of said non-image portion is greater than the specific resistance of said image portion by at least $10^2$ ohm-cm.

34. The electrostatic printing process of claim 29, wherein the specific resistance of the image portion of said layer is less than $10^{10}$ ohm-cm, and wherein the specific resistance of said non-image portion of said layer is greater than $10^{13}$ ohm-cm.

35. The electrostatic printing process of claim 29, wherein the thickness of said layer is from 1 to 50 microns.

36. The electrostatic printing process of claim 29, wherein said silver image is formed from a silver salt compound capable of forming isolated silver.

37. The electrostatic printing process of claim 36, wherein said heating is conducted prior to said developing step.

38. The electrostatic printing process of claim 36, wherein said heating is conducted at a temperature of from 40° to 120° C.

39. The electrostatic printing process of claim 36, wherein said silver salt is an organic silver salt.

40. The electrostatic printing process of claim 39, wherein said silver image is formed from said organic silver salt by conducting at least the steps of imagewise exposure and heat-developing.

41. The electrostatic printing proces of claim 40, wherein said layer comprises an insulating medium, an organic silver salt, a halide and a reducing agent.

42. In an electrostatic printing process which includes the repeated steps of transferring a developed visible image formed on a smooth-surfaced electrostatic printing master, stable towards exposure to light or maintenance in the dark, having a layer which comprises an insulating medium having an electric resistance sufficient to retain an electrostatic charge and a conductive silver image in said insulating medium, onto a support therefor, the improvement comprising enhancing the electrical conductivity of said silver image by heating said master at least once during said printing process sufficient to reduce the tendency of said developer to adhere thereto and create undeisred fog, whereby said enhanced conductivity is imparted to said silver image portion through at least about 10 cycles of printing.

43. The electrostatic printing process of claim 42, including fixing the transferred image.

44. The electrostatic printing process of claim 42, wherein said heating is conducted prior to said visible image being developed.

45. The electrostatic printing process of claim 42, wherein said heating is conducted at a temperature of from 40° to 120° C.

46. The electrostatic printing process of claim 42, wherein the specific resistance of the image portion of said layer is less than $10^{13}$ ohm-cm, wherein the specific resistance of the non-image portion of said layer is greater than $10^{10}$ ohm-cm, and wherein the specific resistance of said non-image portion is greater than the specific resistance of said image portion by at least $10^2$ phm-cm.

47. The electrostatic printing process of claim 42, wherein the specific resistance of the image portion of said layer is less than $10^{10}$ ohm-cm, and wherein the specific resistance of said non-image portion of said layer is greater than $10^{13}$ ohm-cm.

48. The electrostatic printing process of claim 42, wherein the thickness of said layer is from 1 to 50 microns.

49. The electrostatic printing process of claim 42, wherein said silver image is formed from a silver salt compound capable of forming isolated silver.

50. The electrostatic printing process of claim 49, wherein said heating is conducted prior to said developing step.

51. The electrostatic printing process of claim 49, wherein said heating is conducted at a temperature of from 40° to 120° C.

52. The electrostatic printing process of claim 49, wherein said silver salt is an organic silver salt.

53. The electrostatic printing process of claim 52, wherein said silver image is formed from said organic silver salt by conduting at least the steps of imagewise exposure and heat-developing.

54. The electrostatic printing process of claim 53, wherein said layer comprises an insulating medium, an organic silver salt, a halide and a reducing agent.

55. In an electrostatic printing process which includes the steps of forming an electrostatic latent image on a smooth-surfaced electrostatic printing master, stable towards exposure to light or maintenance in the dark, having a layer which comprises an insulating medium having an electric resistance sufficient to retain an electrostatic charge and a conductive silver image in said insulating medium, transferring said electrostatic latent image onto a support therefor, and then developing the transferred electrostatic latent image on said support to form a visible image, the improvement comprising enhancing the electrical conductivity of said silver image by heating said master at least once during said printing process sufficient to reduce the tendency of said developer to adhere thereto and create undesired fog, whereby said enhanced conductivity is imparted to said silver image portion through at least about 10 cycles of printing.

56. The electrostatic printing process of claim 55, including the step of cleaning said master after said transferring step.

57. The electrostatic printing process of claim 55, including the step of fixing the transferred image.

58. The electrostatic printing process of claim 55, wherein said support comprises an electrically-insulating material and wherein said transferring step is conducted by placing said support in close face-to-face relationship with the master bearing the latent image and applying an electric field thereto to form a second electrostatic latent image on said support.

59. The electrostatic printing process of claim 55, wherein said transferring step comprises arranging said support in a face-to-face relationship to said master and short-circuiting the back surface of said support and the back surface of said master to form a second electrostatic latent image on said support.

60. The electrostatic printing process of claim 55, wherein said heating step is conducted prior to said transferring step.

61. The elecrostatic printing process of claim 55, wherein said heating is conducted at a temperature of from 40° to 120° C.

62. The electrostatic printing process of claim 55, wherein the specific resistance of the image portion of said layer is less than $10^{13}$ ohm-cm, wherein the specific resistance of the non-image portion of said layer is greater than $10^{10}$ ohm-cm, and wherein the specific resistance of said non-image portion is greater than the specific resistance of said image portion by at least $10^2$ ohm-cm.

63. The electrostatic printing process of claim 55, wherein the specific resistance of the image portion of said layer is less than $10^{10}$ ohm-cm, and wherein the specific resistance of said non-image portion of said layer is greater than $10^{13}$ ohm-cm.

64. The electrostatic printing process of claim 55, wherein the thickness of said layer is from 1 to 50 microns.

65. The electrostatic printing process of claim 55, wherein said silver image is formed from a silver salt compound capable of forming isolated silver.

66. The electrostatic printing process of claim 65, wherein said heating is conducted prior to said developing step.

67. The electrostatic printing process of claim 65, wherein said heating is conducted at a temperature of from 40° to 120° C.

68. The electrostatic printing process of claim 65, wherein said silver salt is an organic silver salt.

69. The electrostatic printing process of claim 68, wherein said silver image is formed from said organic silver salt by conducting at least the steps of imagewise exposure and heat-developing.

70. The electrostatic printing process of claim 69, wherein said layer comprises an insulating medium, an organic silver salt, a halide and a reducing agent.

71. In an electrostatic printing process which includes the steps of forming an electrostatic latent image on a smooth-surfaed electrostatic printing master, stable towards exposure to light or maintenance in the dark, having a layer which comprises an insulating medium having an electric resistance sufficient to retain an electrostatic charge and a conductive silver image in said insulating medium, transferring the electrostatic latent image onto a support therefor, developing the transferred electrostatic latent image on said support to form a visible image, and then transferring the developed visible image onto another support, the improvement comprising enhancing the electrical conductivity of said silver image by heating said master at least once during said printing process sufficient to reduce the tendency of said developer to adhere thereto and create undesired fog, whereby said enhanced conductivity is imparted to said silver image portion through at least about 10 cycles of printing.

72. The electrostatic printing process of claim 71, including the step of cleaning said master after said transferring step.

73. The electrostatic printing process of claim 71, including fixing the transferred developed visible image.

74. The electrostatic printing process of claim 71, wherein said heating is conducted prior to transferring said latent image.

75. The electrostatic printing process of claim 71, wherein said heating is conducted at a temperature of from 40° to 120° C.

76. The electrostatic printing process of claim 71, wherein the specific resistance of the image portion of said layer is less than $10^{13}$ ohm-cm, wherein the specific resistance of the non-image portion of said layer is greater than $10^{10}$ ohm-cm, and wherein the specific resistance of said non-image portion is greater than the specific resistance of said image portion by at least $10^{2}$ ohm-cm.

77. The electrostatic printing process of claim 71, wherein the specific resistance of the image portion of said layer is less than $10^{10}$ ohm-cm, and wherein the specific resistance of said non-image portion of said layer is greater than $10^{13}$ ohm-cm.

78. The electrostatic printing process of claim 71, wherein the thickness of said layer is from 1 to 50 microns.

79. The electrostatic printing process of claim 71, wherein said silver image is formed from a silver salt compound capable of forming isolated silver.

80. The electrostatic printing process of claim 79, wherein said heating is conducted prior to said developing step.

81. The electrostatic printing process of claim 79, wherein said heating is conducted at a temperature of from 40° to 120° C.

82. The electrostatic printing process of claim 79, wherein said silver salt is an organic silver salt.

83. The electrostatic printing process of claim 82, wherein said silver image is formed from said organic silver salt by conducting at least the steps of imagewise exposure and heat-developing.

84. The electrostatic printing process of claim 83, wherein said layer comprises an insulating medium, an organic silver salt, a halide and a reducing agent.

85. An apparatus for electrostatic printing which comprises means for forming an electrostatic latent image on a smooth-surfaced electrostatic printing master, stable towards exposure to light or maintenance in the dark, having a layer which comprises an insulating medium having an electric resistance sufficient to retain an electrostatic charge and a conductive silver image in said insulating medium, means for developing said latent image to form a visible image, means for transferring the developed visible image onto a support therefor, and means for heating and enhancing the electrical conductivity of said silver image by heating said master at least once during said printing process sufficient to reduce the tendency of the developer to adhere thereto and create undesired fog, whereby said enhanced conductivity is imparted to said silver image portion through at least about 10 cycles of printing.

86. the apparatus of claim 85, wherein said heating means is capable of heating said master prior to said development of the latent image.

87. The apparatus of claim 85, wherein said heating means is capable of heating said master to a temperature of from 40° to 120° C.

88. The apparatus of claim 85, including means to clean said master after said transferring.

89. The apparatus of claim 85, including means for fixing the transferred image.

* * * * *

UNITED STATES PATENT AND TRADEMARK OFFICE

CERTIFICATE OF CORRECTION

PATENT NO. : 4,057,016
DATED : November 8, 1977
INVENTOR(S) : ICHIRO ENDO, ET AL It is certified that error appears in the above-identified patent and that said Letters Patent are hereby corrected as shown below:

Column 5, line 26, delete "as"
Column 5, line 56, change "into" to --in--.
Column 10, line 67, after "may" insert --be--.
Column 12, line 1, delete "to" second occurrence.
Column 15, line 17, change "results" to --values--.
Column 15, line 17, insert --(The above values show the ratio of "Transferred density obtained by using Sample A to transferred density by using Sample B".)--
Column 15, line 52, change "turn" to --turned--.
Column 19, line 44, change "phm-cm" to --ohm-cm--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*